US006447211B1

(12) United States Patent
Scales et al.

(10) Patent No.: US 6,447,211 B1
(45) **Date of Patent: *Sep. 10, 2002**

(54) BLOCKS AND CONNECTOR FOR MECHANICALLY-STABILIZED EARTH RETAINING WALL HAVING SOIL-REINFORCING SHEETS AND METHOD FOR CONSTRUCTING SAME

(75) Inventors: John M. Scales, Norcross; Zehong Yuan, Duluth, both of GA (US)

(73) Assignee: Geostar Corp., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/703,986

(22) Filed: Oct. 25, 2000

(51) Int. Cl.[7] ..... E02D 29/02
(52) U.S. Cl. ..... 405/262; 405/284; 405/286
(58) Field of Search ..... 405/262, 284, 405/285, 286

(56) References Cited

U.S. PATENT DOCUMENTS

| | | | | |
|---|---|---|---|---|
| 3,383,864 A | | 5/1968 | Turzillo | 61/38 |
| 3,686,873 A | | 8/1972 | Vidal | 61/39 |
| 4,116,010 A | | 9/1978 | Vidal | 405/262 |
| 4,324,508 A | | 4/1982 | Hilfiker et al. | 405/284 |
| 4,448,571 A | | 5/1984 | Eckels | 405/284 |
| 4,661,023 A | | 4/1987 | Hilfiker | 405/262 |
| 4,710,062 A | | 12/1987 | Vidal et al. | 405/262 |
| 4,804,299 A | | 2/1989 | Forte et al. | 405/285 |
| 4,824,293 A | | 4/1989 | Brown et al. | 405/284 |
| 4,914,876 A | | 4/1990 | Forsberg | 52/169.4 |
| 5,028,172 A | | 7/1991 | Wilson et al. | 405/286 |
| 5,033,912 A | | 7/1991 | Vidal | 405/262 |
| 5,091,247 A | | 2/1992 | Willibey et al. | 428/255 |
| 5,131,791 A | | 7/1992 | Kitziller | 405/286 |
| 5,145,288 A | | 9/1992 | Borcherdt | 405/284 |
| 5,156,496 A | | 10/1992 | Vidal et al. | 405/262 |
| 5,163,261 A | | 11/1992 | O'Neill | 52/610 |
| 5,277,520 A | | 1/1994 | Travis | 405/128 |
| 5,417,523 A | | 5/1995 | Scales | 405/284 |
| 5,419,092 A | | 5/1995 | Jaecklin | 52/562 |
| 5,511,910 A | * | 4/1996 | Scales | 405/262 |
| 5,607,262 A | * | 3/1997 | Martin | 405/284 |
| 5,800,095 A | | 9/1998 | Egan | 405/262 |
| 5,800,097 A | * | 9/1998 | Martin | 405/284 |
| 5,839,855 A | * | 11/1998 | Anderson et al. | 405/262 |
| 5,934,838 A | * | 8/1999 | Egan | 405/262 |
| 5,975,809 A | * | 11/1999 | Taylor et al. | 405/262 |
| 6,224,295 B1 | * | 5/2001 | Price et al. | 405/262 |

OTHER PUBLICATIONS

Designing with Geosynthetics, Koerner, Robert M., Prentice–Hall, Inc., Englewood Cliffs, NJ 07632, 3rd ed. —p. 37–42;192–199; 328–351.

Safe slope reinforcement and stable embankment construction (undated).

* cited by examiner

*Primary Examiner*—Heather Shackelford
*Assistant Examiner*—Frederick L. Lagman
(74) *Attorney, Agent, or Firm*—Baker, Donelson, Bearman & Caldwell

(57) ABSTRACT

An earth retaining wall made of stacked tiers of blocks placed side by side to form a wall with a channel extending at least partially along a longitudinal axis of the wall in which the channel define at least two adjacent bearing surfaces and a pathway extending from the channel to an exterior side of the wall. The channel receives an elongate clamping bar that conforms in cross-sectional shape at least relative to the bearing surfaces. A reinforcement sheet wrapped around the elongate connector bar extends through the pathway laterally of the wall. The clamping bar communicates tensile loading of backfill on the reinforcement sheet to the wall. The wall is mechanically stabilized by normal loading from the blocks in the wall above a reinforcement sheet and the tensile loading of the backfill communicated by the clamping bar to the wall. A method of constructing an earth retaining wall and blocks useful in such wall are disclosed.

74 Claims, 5 Drawing Sheets

BLOCKS AND CONNECTOR FOR MECHANICALLY-STABILIZED EARTH RETAINING WALL HAVING SOIL-REINFORCING SHEETS AND METHOD FOR CONSTRUCTING SAME

TECHNICAL FIELD

The present invention relates to earth retaining walls. More particularly, the present invention relates to mechanically stabilized earth retaining walls having laterally extending soil reinforcement sheets for connecting the wall to backfill.

BACKGROUND OF THE INVENTION

Mechanically stabilized earth retaining walls are construction devices used to reinforce earthen slopes, particularly where changes in elevations occur rapidly, for example, development sites with steeply sloped embankments. These embankments must be secured, such as by retaining walls, against collapse or failure to protect persons and property from possible injury or damage caused by the slippage or sliding of the earthen slope.

Many designs for earth retaining walls exist today. Wall designs must account for lateral earth and water pressures, the weight of the wall, temperature and shrinkage effects, and earthquake loads. The design type known as mechanically stabilized earth retaining walls employ either metallic or polymeric tensile reinforcements in the soil mass. The tensile reinforcements extend laterally of the wall formed of a plurality of modular facing units, typically precast concrete members, blocks or panels that stack together. The tensile reinforcements connect the soil mass to the blocks that define the wall. The blocks create a visual vertical facing for the reinforced soil mass.

The polymeric tensile reinforcements typically used are elongated lattice-like structures, often referred to as grids. These are stiff polymeric extrusions that define sheet-like structures. The grids have elongated ribs which connect to transversely aligned bars thereby forming elongated apertures between the ribs. As discussed below, other non-extruded tensile reinforcements have been developed.

Various connection methods are used during construction of earth retaining walls to interlock the blocks or panels with the grids. One known type of retaining wall has blocks with bores extending inwardly within the top and bottom surfaces. The bores receive dowels or pins. After a first tier of blocks has been positioned laterally along the length of the wall, the dowels are inserted into the bores of the upper surfaces of the blocks. Edge portions of the grids are placed on the tier of blocks so that each of the dowels extends through a respective one of the apertures. This connects the wall to the grid. The grid extends laterally from the blocks and is covered with back fill. A second tier of blocks is positioned with the upwardly extending dowels fitting within bores of the bottom surfaces of the blocks. The loading of backfill over the grids is distributed at the dowel-to-grid connection points. The strength of the grid-to-wall connection is generated by friction between the upper and lower block surfaces and the grid and by the linkage between the aggregate trapped by the wall and the apertures of the grid. The magnitude of these two contributing factors varies with the workmanship of the wall, normal stresses applied by the weight of the blocks above the connection, and by the quality and size of the aggregate.

Other connection devices are known. For example, my U.S. Pat. No. 5,417,523 describes a connector bar with spaced-apart keys that engage apertures in the grid that extends laterally from the wall. The connector bars are received in channels defined in the upper and lower surfaces of the blocks.

The specifications for earth retaining walls are based upon the strength of the interlocking components and the load created by the backfill. Once the desired wall height and type of ground conditions are known, the number of grids, the vertical spacing between adjacent grids, and lateral positioning of the grids is determined, dependent upon the load capacity of the interlocking components.

Heretofore, construction of such mechanically stabilized earth retaining walls has been limited to large walls involving significantly expensive projects. This is due in part to the cost of the mechanical components used for construction of such large earth retaining walls. To reduce costs, flexible tensile reinforcement sheets other than grids have been developed for use with mechanically stabilized earth retaining walls. These flexible tensile reinforcement sheets include large open-grid woven lattices and small-aperture woven lattices, as well as woven textile sheets. These other tensile reinforcements are significantly less expensive than extruded grids. However, when these other flexible reinforcements are used in construction of mechanically stabilized earth walls, their connection with the wall facing units has been a major technical challenge. Up to now, the flexible reinforcements are connected to the modular blocks through the block-reinforcement friction. The magnitude of the frictional force, (i.e., connection strength) depends on the overburden pressure acting on the reinforcement under consideration. The higher the overburden pressure, the larger the connection strength. For small block walls, the normal stresses that are applied by the weight of blocks are limited and the required connection strength is often difficult to meet.

Accordingly, there is a need in the art for an earth retaining wall that is mechanically stabilized with normal stress by the mass of the blocks in the wall and supplemental loading by connectors transferring tensile loading on reinforcement sheets that extend laterally from the wall into backfill material. It is to such that the present invention is directed.

BRIEF SUMMARY OF THE INVENTION

The present invention meets the need in the art by providing an earth retaining wall, comprising at least two stacked tiers of blocks placed side by side to form a wall with a channel extending at least partially along a longitudinal axis of the wall. The channel defines at least two adjacent bearing surfaces and a pathway that extends from the channel to an exterior side of the wall. The channel receives an elongate connector bar that conforms in cross-sectional shape at least relative to the bearing surfaces. A reinforcement sheet wraps around the connector bar and a portion extends through the pathway laterally of the wall. The connector bar, being wrapped by a portion of the reinforcement sheet and received in the channel with the reinforcement sheet extending laterally and a portion thereof loaded by backfill, mechanically engages the bearing surfaces of the channel to distribute the tensile loading to the bearing surfaces.

In another aspect, the present invention provides an earth retaining wall, comprising at least two stacked tiers of blocks placed side by side to form a wall with a channel extending at least partially along a longitudinal axis of the wall. The channel is defined in at least one of the blocks extending between opposing sides thereof. The block defines a pathway that extends from the channel to an exterior side of the wall. An interior portion of the pathway is defined by an opening between a pair of bearing surfaces to a slot extending from the channel to an exterior side of the block. The channel receives an elongate connector bar that conforms in cross-sectional shape at least relative to the bearing surfaces. A reinforcement sheet wraps around the connector bar and a portion extends through the pathway laterally of the wall. The connector bar, being wrapped by a portion of the reinforcement sheet and received in the channel with the reinforcement sheet extending laterally and a portion thereof loaded by backfill, mechanically engages the bearing surfaces of the channel to distribute the tensile loading across the wall.

In another aspect, the present invention provides a method of constructing an earth retaining wall, comprising the steps of:

(a) placing first and second tiers of blocks side by side to define a length of a wall with a channel extending at least partially along a longitudinal length thereof, the channel defining at least two bearing surfaces, and a pathway extending from the channel to an exterior side of the wall;

(b) wrapping a portion of a reinforcement sheet over a connector conforming in cross-sectional shape at least relative to the two bearing surfaces;

(c) positioning the connector and the reinforcement sheet within the channel with a portion of the reinforcement sheet extending along the pathway laterally of the wall;

(d) covering the portion of the reinforcement sheet lateral of the wall with backfill, whereby the connector, being wrapped by the reinforcement sheet loaded by backfill, mechanically engages the two bearing surfaces of the channel such that the loading is distributed across the wall.

In another aspect, the present invention provides a block for constructing an earth retaining wall formed of a plurality of the blocks placed side-by-side in tiers. Each block defines two opposing sides, a top and an opposing bottom, and a front face and an opposing back face. The block defines a channel that extends between the opposing sides for receiving a clamping bar therein. The channel defines at least two adjacent bearing surfaces for engaging surf aces of the clamping bar and an opening between the bearing surfaces to a slot that extends from the channel to the top face of the block for receiving therein a portion of a reinforcement sheet. The block, receiving the clamping bar wrapped with a portion of the reinforcement sheet that extends through the slot laterally of block, bears loading from the backfill covering the reinforcement sheet communicated by the clamping bar against the bearing surfaces of the block.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
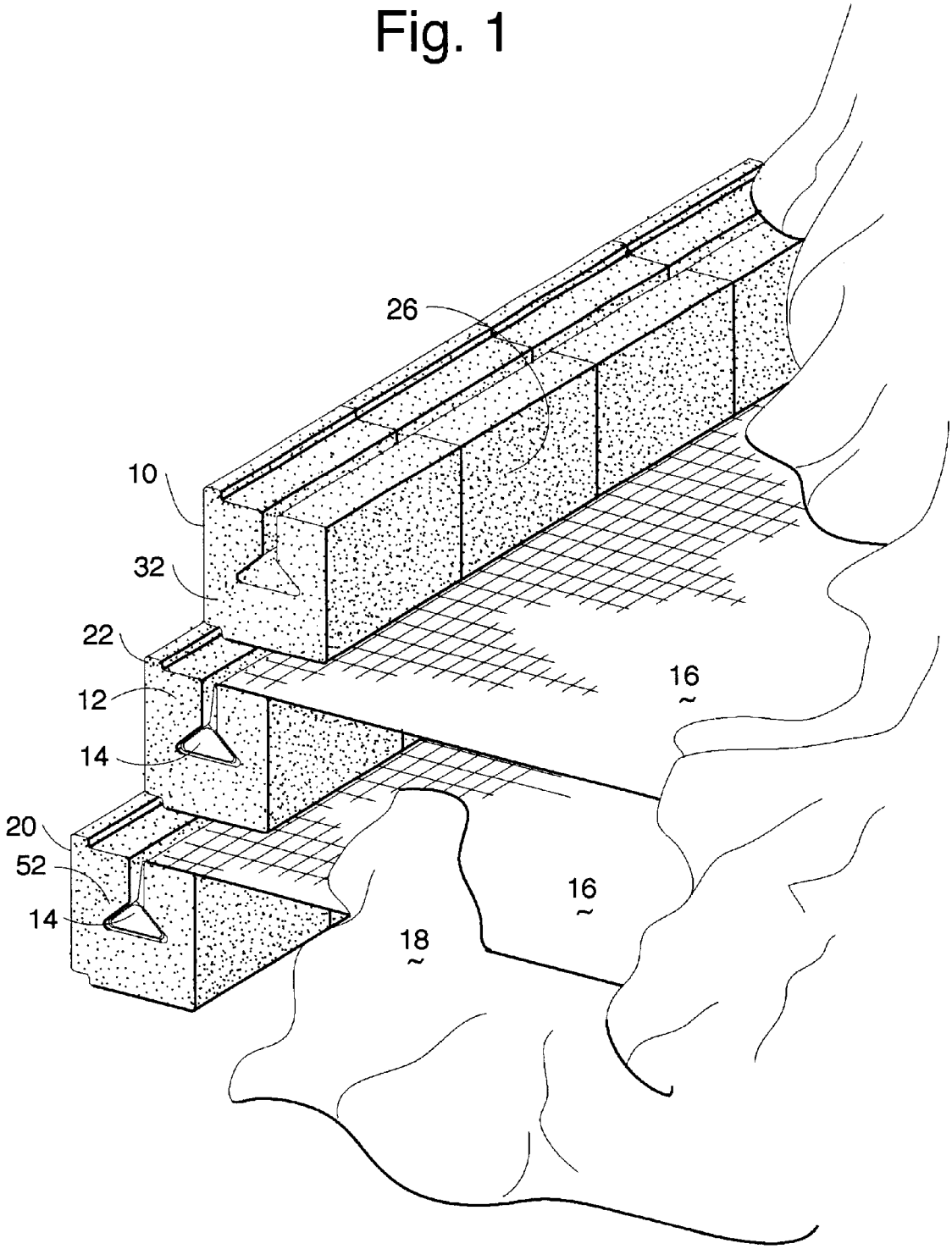
FIG. 1 illustrates a perspective cut-away view of an earth retaining wall according to the present invention.

Referring now in more detail to the drawings in which like parts have like identifiers, FIG. 1 is a perspective view of a mechanically stabilized earth retaining wall 10 according to the present invention. The wall 10 comprises a plurality of stacked, interconnected blocks 12 which receive connectors or clamping bars 14 that engage open reinforcement sheets 16. As discussed below the clamping bars 14 extend through aligned channels 52 in the blocks 12. The reinforcement sheets 16 extend laterally of the wall 10 into backfill 18 at selected vertical intervals. The clamping bars 14 communicate the tensile loading on the reinforcement sheets 16 to bearing surfaces in the wall 10.

The wall 10 comprises at least two tiers 20, 22 of the blocks 12 from which the reinforcement sheets 16 extend laterally. The blocks 12 in each tier 22, 24 are placed side-by-side to form the elongated retaining wall 10. Soil, gravel, or other backfill material 18 is placed on an interior side 26 of the wall 10.

Figure 2:
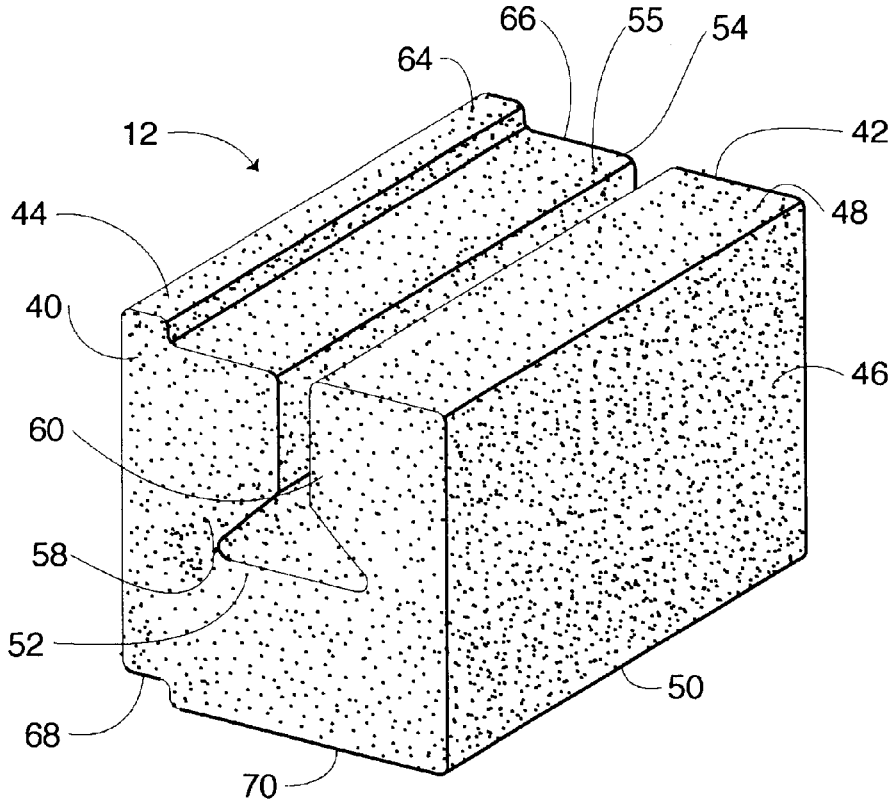
FIG. 2 illustrates in perspective view a block according to the present invention for constructing an earth retaining wall as illustrated in FIG. 1.

With reference to the perspective view in FIG. 2, each of the blocks 12 is defined by opposing side walls 40, 42, opposing front face 44 and back face 46, and opposing top and bottom sides 48, 50. The block 12 defines a channel 52 extending between the opposing sides 40, 42. In a preferred embodiment, the channel 52 defines a triangular shape in cross-sectional view. In a preferred embodiment, the triangular channel 52 is substantially equilateral with radiused apexes. The channel 52 opens to a slot 54 that extends vertically from the channel to the top side 48 of the block 12. The slot 54 preferably defines opposed smoothly tapered edges 55 in the top face 48. The slot 54 preferably opens to the channel 52 at an apex. The channel 52 defines a pair of planar bearing surfaces 58, 60, for a purpose discussed below. The opening to the slot 54 is preferably between the two bearing surfaces 58, 60. The top surface 48 from the slot 54 to the back face 46 is recessed relative to the portion from the slot 54 towards the front face 44, to accommodate the thickness of the reinforcement fabric 16.

The blocks 12 or panels, that define the facing of the wall 10 are preferably pre-cast concrete. As is conventional with blocks for earth retaining walls, the illustrated embodiment of the block 12 includes matingly conformable top and bottom surfaces 48, 50. In the illustrated embodiment, the top surface defines a raised portion 64 and a recessed portion 66. The opposing bottom 50 likewise defines a recess portion 68 and an extended portion 70. The recess portion 66 in the top 48 opposes the extended portion 70 in the bottom 50. The raised portion 64 opposes the recess portion 68. When blocks 12 are stacked in tiers 20, 22, the recessed portion 66 of blocks in the lower tier 20 receive the respective extended portion 70 of the blocks 12 in the upper tier 22. Similarly, the raised portions 64 in the lower tier 20 are received in the respective recesses 68 of the upper tier 22. In this way, the blocks 12 in vertically adjacent tiers 20, 22 are matingly engaged.

Figure 3:
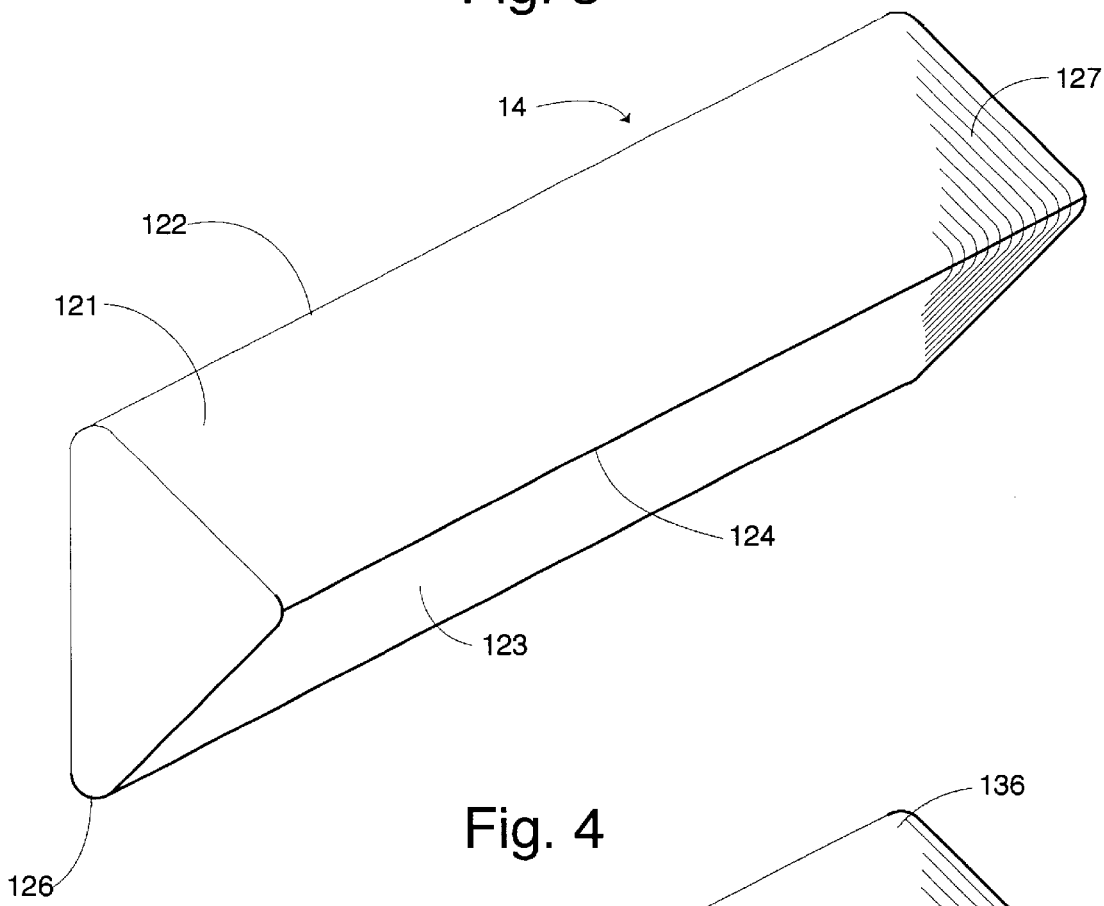
FIG. 3 illustrates in perspective view an embodiment of a connector bar for constructing an earth retaining wall illustrated in FIG. 1.

FIG. 3 is a perspective view of an embodiment of the clamping bar 14 according to the present invention. The clamping bar 14 is received in the channel 52 of the block 12. The clamping bar 14 communicates the tensile loading from the reinforcement sheet 16 to the wall 10. In cross-sectional view, the clamping bar 14 defines a substantially triangular shape for conformingly being received within a preferred form of the channel 52. The clamping bar 14 has at least two surfaces 121, 123 that conform to the bearing surfaces 58, 60 in the channel 52. In a preferred embodiment, the clamping bar 14 defines an equilateral triangle to facilitate installation in the channels 52. In this embodiment, the orientation of the clamping bar does not need to be evaluated during installation in the field, thereby saving time. The clamping bar 14 defines three apexes 122, 124, and 126. In the illustrated embodiment, the apexes 122, 124, and 126 define radiused apexes. For example, the clamping bar 14 in one embodiment has a length of twelve inches, and equilateral sides of approximately 1.5 inches reduced slightly to accommodate the apex radiuses of 0.1094 inches. In one embodiment, the exterior surfaces of the clamping bar 14 have texturing generally 127, such as spaced-apart grooves and ridges, cross-hatching, roughened projections and recessed areas and the like, for a purpose discussed below. The clamping bar 14 is preferably formed of a high strength flexible material, such as rubber or plastic such as a flexible PVC.

Figure 4:
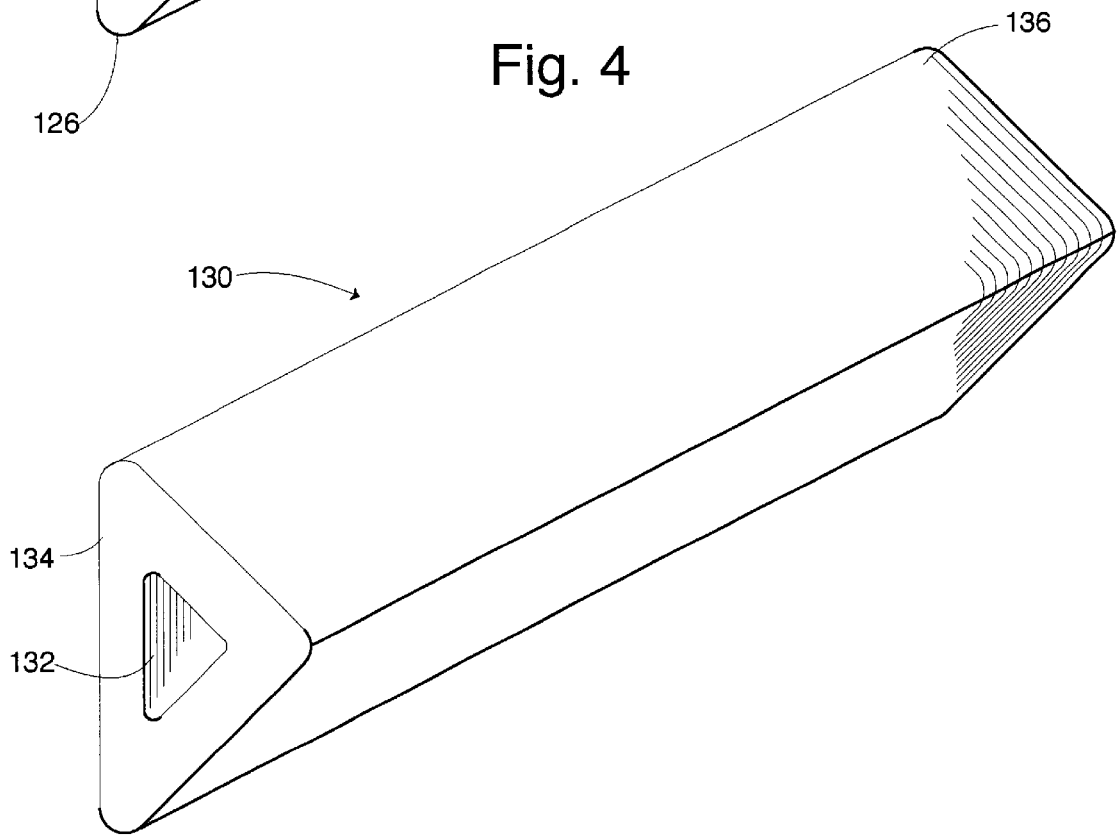
FIG. 4 illustrates in perspective view an alternate embodiment of a connector bar illustrated in FIG. 4.

FIG. 4 is a perspective view of an alternate embodiment 130 of a clamping bar of the present invention.

In this embodiment, the clamping bar 130 defines a cavity 132 extending between opposing distal ends 134, 136 along a longitudinal axis. In the illustrated embodiment, the cavity 132 conforms in cross-sectional shape to the cross-sectional shape of clamping bar 130.

Figure 8:
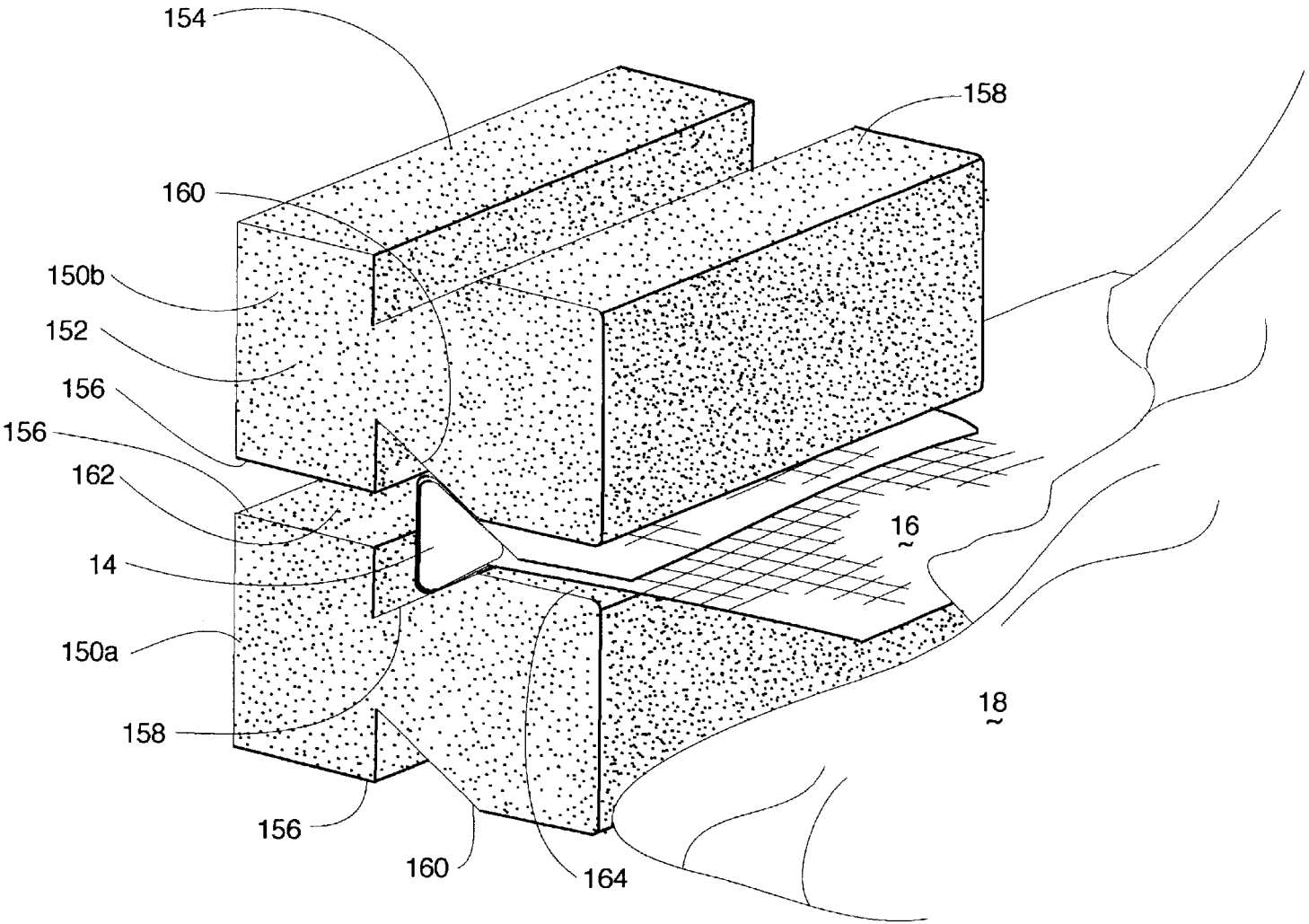
FIG. 8 illustrates in perspective view an alternate embodiment of a block for constructing an earth retaining wall according to the present invention.

FIG. 8 illustrates in perspective slightly exploded view a portion of an earth retaining wall according to the present invention constructed with an alternate embodiment of a block 150. The block 150 is defined by opposing side walls 152, opposing front face and back face, and opposing top and bottom sides 154, 156. The block 150 defines a pair of channels 158, 160 extending between the opposing sides 152 in the top and bottom sides 154, 156, respectively. In a preferred embodiment, the channels 158, 160 define a triangular shape in cross-sectional view. In a preferred embodiment, the triangular channels 158, 160 are substantially right triangles with radiused apexes. The blocks 150 are stacked together to form the retaining wall. Aligning the channel 160 in a lower block 150*a* with the channel 158 in a vertically higher block 150*b* defines a larger triangular channel 162 extending between the side walls 152 of the blocks.

When stacked together to define the retaining wall, the blocks 150*a*, 150*b* define a slot 164 open to the channel 162. The slot 164 receives a portion of the reinforcement sheet 16 that extends laterally of the blocks 150 into the backfill 18. The edges of the blocks 150 at the distal ends of the defined slot are preferably smoothly tapered. The aligned channels 158, 160 define a pair of planar bearing surfaces 168, 170, for bearing against the bearing surfaces 121, 123 of the clamping bar 14.

Figure 5:
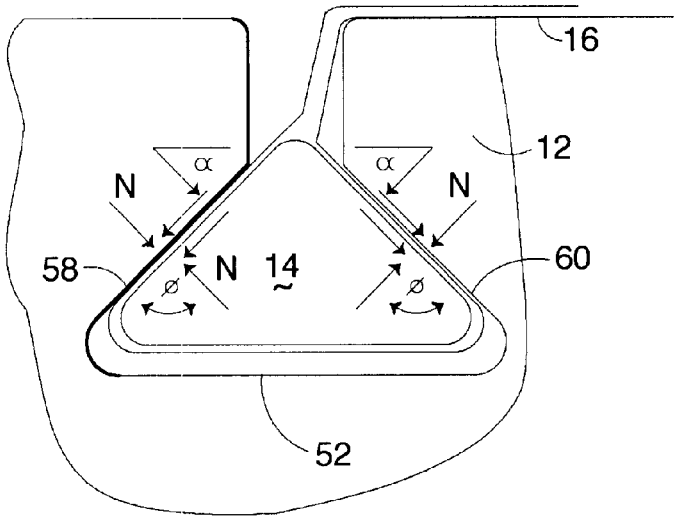
FIG. 5 illustrates a design concept for the present invention.

With reference to FIG. 5, a design for the mechanically stabilized wall 10 may be described as follows, where:

P is the pull-out loading for the reinforcement sheet 16, which equals the resisting force of the friction between the clamping bar 14 and the bearing surfaces 58, 60 of the block 12.

N is the normal loading between the bearing surfaces 58, 60 and the clamping bar 14.

$\alpha$ is the angle between the normal load N and a line of force on the reinforcement sheet 16.

$\phi$ is the friction angle at the planar interface between the reinforcement sheet 16 and the clamping bar 14. This angle controls the self-locking attribute of the apparatus of the present invention.

The present invention is described by the following equation:

$$P=2\,N\sin\alpha \qquad \text{(Eq.1)}$$

The mobilized peak pull-out resistance is represented by the frictional load between the reinforcement sheet 16 and the bearing surfaces 58, 60 of the channel 52 and between the reinforcement sheet 16 and the clamping bar 14. The tensile loading on the reinforcement sheet 16 accordingly is resisted by four surfaces of frictional loading. This is described by the following equation:

$$P=4\,N\tan\phi \qquad \text{(Eq.2)}$$

Combining equations one and two shows:

$$2\,N\sin\alpha=4\,N\tan\phi \qquad \text{(Eq. 3)}$$

which reduces to $$\sin\alpha=2\tan\phi \qquad \text{(Eq. 4)}$$

Generally, higher values of the angle $\phi$ provide increased self-locking capability of the clamping bars 14.

For example, assume that $\alpha$ equals 30°. In order to have a reinforcement sheet 16 fully locked in the block 12 by the clamping bar 14, $\phi \geqq$ arc tan (sin alpha/2), or arc tan (0.5/2).

Accordingly, $\phi \geqq 14°$.

It is noted that the friction angle $\phi$ between a clamping bar 14 and a reinforcement sheet 16 is likely greater than the computed 14°, thereby achieving the self-lock pull-out resistance of the present invention. In the event that sliding failure mode occurs, the angle of $\alpha$ can be reduced, and thus a smaller $\phi$ will meet the requirements for self-lock securing of the reinforcement sheet 16 to the block 12 by the clamping bar 14.

With reference to FIG. 1, the mechanically stabilized earth retaining wall 10 is assembled by placing a plurality of blocks 12 in the tiers 20, 22. A reinforcement sheet 16 is wrapped around one of the clamping bars 14. The clamping bar 14 with the wrapped reinforcement sheet 16 then is slidably inserted into the aligned channels 52 of the blocks 12 in a particular tier. The reinforcement sheet 16 is slidably moved through the slot 54 and extended laterally of the back face 46 of the blocks 12 that define the wall 10. Preferably the side portion of the reinforcement sheet wraps around the clamping bar such that a side edge extends outwardly of the block through the slot. The sheet 16 is pulled to fix the clamping bar 14 wedgingly in the opening to the slot 54. Backfill 18 covers the laterally extending reinforcement sheet 16. The loading on the reinforcement sheet impels the clamping bar 14 to maintain the wedging engagement with the opening between the bearing surfaces of the channel 52. This locks the reinforcement sheet 16 in place together with the clamping bar 14.

Additional tiers of blocks 12 are placed in the wall with clamping bars 14 engaging reinforcement sheets 16 at selected vertical intervals. Backfill 18 is poured over the laterally extending reinforcement sheets 16 in order to load the clamping bars 14 into bearing engagement with the bearing surfaces of the blocks. The clamping bars 14 distribute the loading from the reinforcement sheets 16 to the blocks 12. Construction of the wall 10 continues until appropriate tiers and reinforcement sheets are connected together until the design height of the wall is reached.

Figure 6:
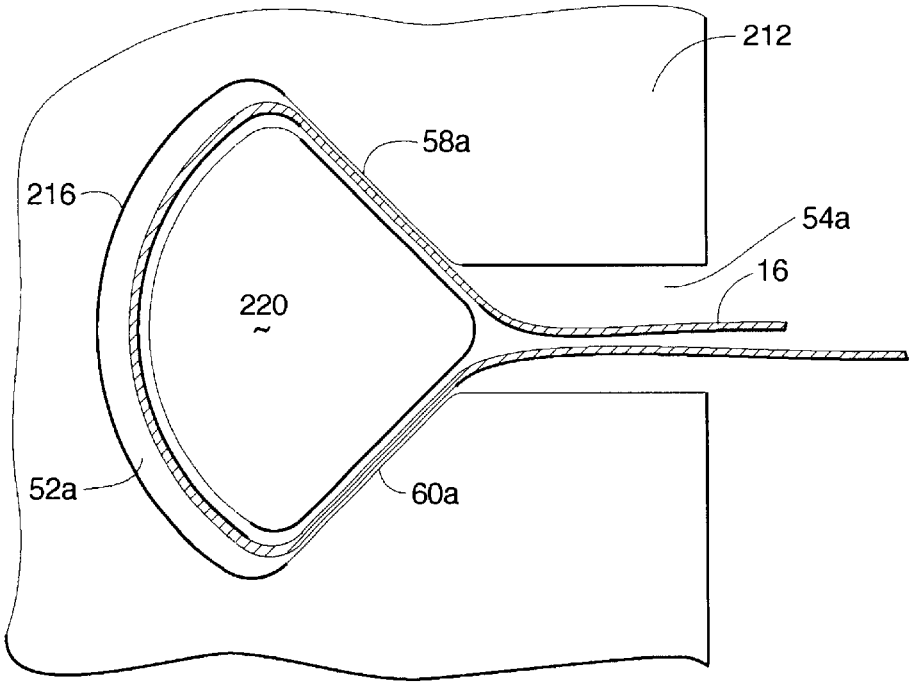
FIGS. 6 and 7 illustrate cross-sectional views of alternate embodiments of blocks defining channels useful with the present invention.
Figure 7:
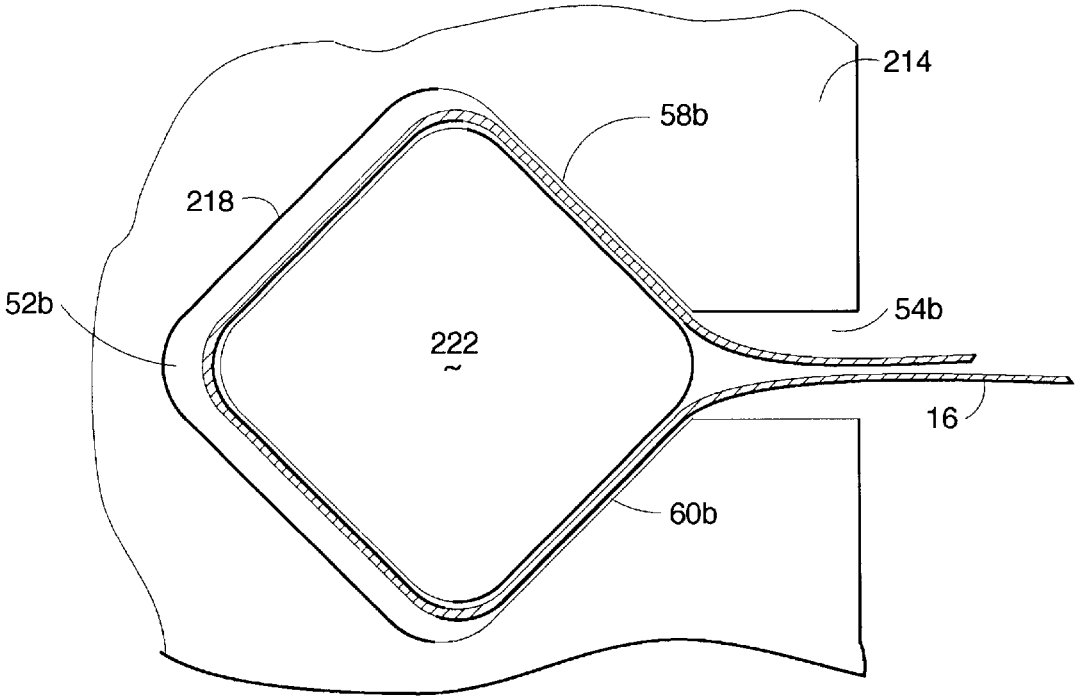

The channel 52 defines the pair of bearing surfaces 58, 60 which are smooth for providing intimate bearing contact with a portion of the reinforcement sheet 16 backed by the respective bearing surfaces 121, 123 of the clamping bar 14. FIGS. 6 and 7 illustrate alternate embodiments of the blocks 212, 214. The channels 52*a*, 52*b* of the blocks 212, 214 define non-linear configurations generally 216, 218 respectively in cross-sectional view. The channels 52*a*, 52*b* receive clamping bars 220, 222 which conform substantially in cross-section to that of the channel. These provide additional surface friction contact between the reinforcement sheet 15 and the clamping bar across channel surfaces opposing the slots 54*a*, 54*b*. Particularly, however, the bearing surfaces of the clamping bars 220, 222 substantially conform to the bearing surfaces of the channel. The planar faces of the respective bearing surfaces 58*a*, 58*b*, 60*a*, 60*b* are of a relatively smooth texture (i.e. without extreme projections therefrom) such as is commonly found in conventional cement blocks.

It is thus seen that the present invention as disclosed herein provides mechanically stabilized earth retaining walls with soil-reinforcement sheets secured by normal stress by the block mass in the wall supplemented by tensile loading communicated to bearing surfaces of the blocks, together with methods, blocks, and clamping bars, useful with the present invention. While this invention has been described in detail with particular reference to the preferred embodiments thereof, the principles and modes of operation of the present invention have been described in the foregoing specification. The invention is not to be construed as limited to the particular forms disclosed because these are regarded as illustrative rather than restrictive. Moreover, modifications, variations and changes may be made by those skilled in the art without departure from the spirit and scope of the invention as described by the following claims.

What is claimed is:

1. An earth retaining wall, comprising:

at least two stacked tiers of blocks placed side by side to form a wall with a channel extending at least partially along a longitudinal axis of the wall, the channel defining a substantially triangular shape in transverse cross-sectional view with at least two adjacent bearing surfaces and a pathway extending from the channel to an exterior side of the wall;

an elongate connector bar, conforming in cross-sectional shape at least relative to the bearing surfaces, received within the channel; and a reinforcement sheet wrapped around the elongate connector bar and a portion thereof extending through the pathway laterally of the wall, whereby the connector bar, being wrapped by a portion of the reinforcement sheet and received in the channel with the reinforcement sheet extending laterally and a portion thereof loaded by backfill, mechanically engages the bearing surfaces of the channel to distribute the tensile loading to the block.

2. The earth retaining wall as recited in claim 1, wherein the connector defines a triangular shape in cross-sectional view.

3. The earth retaining wall as recited in claim 2, wherein the connector defines a second channel extending along a longitudinal axis thereof.

4. The earth retaining wall as recited in claim 2, wherein the pathway opens to the channel at an apex thereof.

5. The earth retaining wall as recited in claim 2, wherein the connector defines textured exterior surfaces.

6. The earth retaining wall as recited in claim 1, wherein the channel and the connector each define an equilateral triangle in cross-sectional view.

7. The earth retaining wall as recited in claim 6, wherein the connector defines a second channel extending along a longitudinal axis thereof.

8. The earth retaining wall as recited in claim 6, wherein the pathway defines arcuately tapered edge surfaces at the exterior side.

9. The earth retaining wall as recited in claim 6, wherein the pathway opens to the channel at an apex thereof.

10. The earth retaining wall as recited in claim 6, wherein the clamping bar defines textured exterior surfaces.

11. The earth retaining wall as recited in claim 1, wherein the pathway defines arcuately tapered edge surfaces at the exterior side.

12. The earth retaining wall as recited in claim 1, wherein the pathway opens to the channel at an apex thereof.

13. The earth retaining wall as recited in claim 1, wherein the connector defines textured exterior surfaces.

14. The earth retaining wall as recited in claim 1, wherein opposing upper and lower surfaces of the blocks define opposed mating surfaces for interlocking adjacent tiers of blocks.

15. The earth retaining wall as recited in claim 1, wherein the connector defines a second channel extending along a longitudinal axis thereof.

16. The earth retaining wall as recited in claim 1, wherein the channel is defined in at least one of the blocks extending between opposing sides thereof, the channel defining the two bearing surfaces inwardly of the block and an interior portion of the pathway defined by an opening between the bearing surfaces to a slot extending from the channel to an exterior side of the block.

17. The earth retaining wall as recited in claim 16, wherein opposing surfaces of adjacent blocks in the tiers define an exterior portion of the pathway.

18. The earth retaining wall as recited in claim 16, wherein the pathway extends to the top side of the block.

19. The earth retaining wall as recited in claim 16, wherein the connector defines a triangular shape in cross-sectional view.

20. The earth retaining wall as recited in claim 19, wherein the connector defines a second channel extending along a longitudinal axis thereof.

21. The earth retaining wall as recited in claim 19, wherein the pathway defines arcuately tapered edge surfaces at the exterior back side.

22. The earth retaining wall as recited in claim 19, wherein the pathway opens to the channel at an apex thereof.

23. The earth retaining wall as recited in claim 19, wherein the connector defines textured exterior surfaces.

24. The earth retaining wall as recited in claim 16, wherein the channel and the connector each define an equilateral triangle in cross-sectional view.

25. The earth retaining wall as recited in claim 24, wherein the connector defines a second channel extending along a longitudinal axis thereof.

26. The earth retaining wall as recited in claim 24, wherein the pathway defines arcuately tapered edge surfaces at the exterior side.

27. The earth retaining wall as recited in claim 24, wherein the pathway opens to the channel at an apex thereof.

28. The earth retaining wall as recited in claim 24, wherein the connector defines textured exterior surfaces.

29. The earth retaining wall as recited in claim 16, wherein the connector defines arcuately tapered edge surfaces at the exterior side.

30. The earth retaining wall as recited in claim 16, to wherein the channel is defined within the block such that a base surface of the channel is substantially parallel to plane defined by a top surface of the block.

31. The earth retaining wall as recited in claim 16, wherein the pathway opens to the channel at an apex thereof.

32. The earth retaining wall as recited in claim 16, wherein the connector defines textured exterior surfaces.

33. The earth retaining wall as recited in claim 16, wherein opposing upper and lower surfaces of the blocks define opposed mating surfaces for interlocking adjacent tiers of blocks.

34. The earth retaining wall as recited in claim 16, wherein the connector defines a second channel extending along a longitudinal axis thereof.

35. A method of constructing an earth retaining wall, comprising the steps of:

(a) placing first and second tiers of blocks side by side to define a length of a wall with a channel extending at least partially along a longitudinal length thereof, the channel defining a substantially triangular shape in transverse cross-sectional view with at least two bearing surfaces, and a pathway extending from the channel to an exterior side of the wall;

(b) wrapping a portion of a reinforcement sheet over a connector conforming in cross-sectional shape at least relative to the two bearing surfaces;

(c) positioning the connector and the reinforcement sheet within the channel with a portion of the reinforcement sheet extending along the pathway laterally of the wall;

(d) covering the portion of the reinforcement sheet lateral of the wall with backfill, whereby the connector, being wrapped by the reinforcement sheet loaded by backfill, mechanically engages the two bearing surfaces of the channel such that the tensile loading is distributed across the wall.

36. The method as recited in claim 35, wherein step (a) is accomplished by first placing the first tier of blocks and placing the second tier of blocks after step (c).

37. If The method as recited in claim 35, further comprising the step of providing each block with opposing upper and lower surfaces with matingly engageable features for joining adjacent tiers of blocks.

38. The method as recited in claim 35, further comprising the step of providing a textured exterior surface to the connector.

39. A method of constructing an earth retaining wall, comprising the steps of:

(a) placing first and second tiers of blocks side by side to define a length of a wall, each of the blocks defining a channel having a triangular shape in cross-sectional view extending between opposing sides thereof and defining a pair of bearing surfaces, the channel opening between the pair of bearing surfaces to a slot extending from the channel to a side of the block;

(b) wrapping a portion of a reinforcement sheet over a connector conforming in cross-sectional shape at least relative to the two bearing surfaces;

(c) positioning the connector and the reinforcement sheet within one of the channels with a portion of the reinforcement sheet extending through the slot laterally of the wall;

(d) covering the portion of the reinforcement sheet lateral of the wall with backfill, whereby the connector, being wrapped by the reinforcement sheet loaded by backfill, mechanically engages the two bearing surfaces of the channel such that the tensile loading is distributed to the block.

40. The method as recited in claim 39, further comprising the step of providing each block with opposing upper and lower surfaces with matingly engageable features for joining adjacent tiers of blocks.

41. The method as recited in claim 39, further comprising the step of providing a textured exterior surface to the connector.

42. A block for constructing an earth retaining wall formed of a plurality of the blocks placed side-by-side in tiers, comprising:

a body defined by two opposing sides, a top and an opposing bottom, and a front face and an opposing back face, the body defining a channel that extends between the opposing sides for receiving a clamping bar therein with the channel defining at least two adjacent bearing surfaces for engaging surfaces of the clamping bar and an opening between the bearing surfaces to a slot that extends from the channel to the top face of the block for receiving therein a portion of a reinforcement sheet, whereby the block, receiving the clamping bar wrapped with a portion of the reinforcement sheet that extends through the slot laterally of block, bears tensile loading from the backfill covering the reinforcement sheet communicated by the clamping bar against the bearing surfaces of the block.

43. The block as recited in claim 42, wherein the channel defines a triangular shape in cross-sectional view.

44. The block as recited in claim 43, wherein the clamping bar defines a triangular shape in cross-sectional view.

45. The block as recited in claim 43, wherein the clamping bar defines a second channel extending along a longitudinal axis thereof.

46. The block as recited in claim 43, wherein the pathway opens to the channel at an apex thereof.

47. The block as recited in claim 43, wherein the clamping bar defines textured exterior surfaces.

48. The block as recited in claim 45, wherein the channel and the clamping bar each define an equilateral triangle in cross-sectional view.

49. The block as recited in claim 48, wherein the clamping bar defines a second channel extending along a longitudinal axis thereof.

50. The block as recited in claim 48, wherein the slot defines arcuately tapered edge surfaces at the exterior side.

51. The block as recited in claim 48, wherein the slot opens to the channel at an apex thereof.

52. The block as recited in claim 48, wherein the clamping bar defines textured exterior surfaces.

53. The block as recited in claim 43, wherein the slot defines arcuately tapered edge surfaces at the exterior side.

54. The block as recited in claim 43, wherein the slot opens to the channel at an apex thereof.

55. The block as recited in claim 43, wherein the clamping bar defines textured exterior surfaces.

56. The block as recited in claim 43, wherein opposing upper and lower surfaces of the blocks define opposed mating surfaces for engaging adjacent tiers of blocks.

57. The block as recited in claim 43, wherein the clamping bar defines a second channel extending along a longitudinal axis thereof.

58. A block for constructing an earth retaining wall formed of a plurality of the blocks placed side-by-side in tiers, comprising:

a body defined by two opposing sides, a top and an opposing bottom, and a front face and an opposing back face, the body defining a channel having a triangular shape in cross-sectional view which extends between the opposing sides for receiving a clamping bar therein, the channel defining two interior bearing surfaces for engaging surfaces of the clamping bar, and defining an opening between the bearing surfaces to a slot that extends from the channel to a top face of the block for receiving therein a portion of a reinforcement sheet, whereby the block, receiving the clamping bar wrapped with a portion of the reinforcement sheet that extends through the slot laterally of the block, bears tensile loading from the backfill covering the reinforcement sheet communicated by the clamping bar against the bearing surfaces of the block.

59. The block as recited in claim 58, wherein the channel defines a triangular shape in cross-sectional view.

60. The block as recited in claim 59, wherein the clamping bar defines a triangular shape in cross-sectional view.

61. The block as recited in claim 60, wherein the clamping bar defines a second channel extending along a longitudinal axis thereof.

62. The block as recited in claim 60, wherein the pathway opens to the channel at an apex thereof.

63. The block as recited in claim 62, wherein the clamping bar defines textured exterior surfaces.

64. The block as recited in claim 62, wherein the channel and the clamping bar each define an equilateral triangle in cross-sectional view.

65. The block as recited in claim 62, wherein the clamping bar defines a second channel extending along a longitudinal axis thereof.

66. The block as recited in claim 62, wherein the slot defines arcuately tapered edge surfaces at the exterior side.

67. The block as recited in claim 62, wherein the slot opens to the channel at an apex thereof.

68. The block as recited in claim 62, wherein the clamping bar defines textured exterior surfaces.

69. The block as recited in claim 58, wherein the slot defines arcuately tapered edge surfaces at the exterior side.

70. The block as recited in claim 58, wherein the slot opens to the channel at an apex thereof.

71. The block as recited in claim 58, wherein the clamping bar defines textured exterior surfaces.

72. The block as recited in claim 58, wherein opposing upper and lower surfaces of the blocks define opposed mating surfaces for engaging adjacent tiers of blocks.

73. The block as recited in claim 58, wherein the clamping bar defines a second channel extending along a longitudinal axis thereof.

74. An earth retaining wall, comprising:

at least two stacked tiers of blocks placed side by side to form a wall with a channel extending at least partially along a longitudinal axis of the wall, the channel defining at least two adjacent bearing surfaces and a pathway extending from the channel to an exterior side of the wall, the channel defined in at least one of the blocks extending between opposing sides thereof, the channel defining the two bearing surfaces inwardly of the block a base surface of the channel substantially parallel to plane defined by a top surface of the block and an interior portion of the pathway defined by an opening between the bearing surfaces to a slot extending from the channel to an exterior side of the block;

an elongate connector bar, conforming in cross-sectional shape at least relative to the bearing surfaces, received within the channel; and a reinforcement sheet wrapped around the elongate connector bar and a portion thereof extending through the pathway laterally of the wall, whereby the connector bar, being wrapped by a portion of the reinforcement sheet and received in the channel with the reinforcement sheet extending laterally and a portion thereof loaded by backfill, mechanically engages the bearing surfaces of the channel to distribute the tensile loading to the block.

* * * * *